US009719332B2

(12) United States Patent
Zamora et al.

(10) Patent No.: US 9,719,332 B2
(45) Date of Patent: Aug. 1, 2017

(54) METHOD OF MINIMIZING WELLBORE INSTABILITY

(75) Inventors: Mario Zamora, Houston, TX (US); Quanxin Guo, Sugar Land, TX (US); Sanjit Roy, Houston, TX (US)

(73) Assignee: M-I L.L.C., Houston, TX (US)

( * ) Notice: Subject to any disclaimer, the term of this patent is extended or adjusted under 35 U.S.C. 154(b) by 736 days.

(21) Appl. No.: 13/983,010

(22) PCT Filed: Jan. 31, 2012

(86) PCT No.: PCT/US2012/023345
§ 371 (c)(1),
(2), (4) Date: Oct. 3, 2013

(87) PCT Pub. No.: WO2012/106348
PCT Pub. Date: Aug. 9, 2012

(65) Prior Publication Data

US 2014/0032192 A1 Jan. 30, 2014

Related U.S. Application Data

(60) Provisional application No. 61/437,912, filed on Jan. 31, 2011.

(51) Int. Cl.
*G06G 7/48* (2006.01)
*E21B 43/00* (2006.01)
*E21B 44/00* (2006.01)

(52) U.S. Cl.
CPC ..... *E21B 43/00* (2013.01); *E21B 44/00* (2013.01)

(58) Field of Classification Search
CPC ..... E21B 43/00; E21B 44/00
USPC ..... 703/10
See application file for complete search history.

(56) References Cited

U.S. PATENT DOCUMENTS 7,003,439 B2 2/2006 Aldred et al.
2002/0010548 A1* 1/2002 Tare ..... E21B 21/08 702/9
2002/0177955 A1* 11/2002 Jalali ..... E21B 44/00 702/9
2005/0209836 A1* 9/2005 Klumpen ..... G05B 19/41885 703/10

(Continued)

OTHER PUBLICATIONS

Shigemi Nafafawa, Komei Okatsu, "Equivalent-Circulating Density Fluctuation in Extended Reach Drilling" JPT Feb. 2009, pp. 64-67.*

(Continued)

*Primary Examiner* — Dwin M Craig
(74) *Attorney, Agent, or Firm* — Sara M. Hinkley

(57) ABSTRACT

A process for reducing wellbore instability includes inputting pre-drilling assessment information into an hydraulics analysis and wellbore stability application, inputting a well plan into the hydraulics and wellbore analysis application, inputting a parameter measured at the wellsite into the hydraulics and wellbore stability analysis application, inputting an observation made at the wellsite into the hydraulics and wellbore stability analysis application, integrating the pre-drilling assessment information, the measured parameter, and the observation into the wellbore strengthening analysis application, and adjusting a drilling fluid parameter in response to the integrated pre-drilling assessment information, the measured parameter, and the observation.

18 Claims, 5 Drawing Sheets

(56) References Cited

U.S. PATENT DOCUMENTS

| | | | | |
|---|---|---|---|---|
| 2005/0228905 | A1* | 10/2005 | Veeningen | G06Q 10/0635 710/1 |
| 2008/0042870 | A1* | 2/2008 | Orban | E21B 47/0905 340/854.2 |
| 2008/0190190 | A1* | 8/2008 | Tan | E21B 21/08 73/152.18 |
| 2009/0188718 | A1 | 7/2009 | Kaageson-Loe et al. | |
| 2009/0194330 | A1 | 8/2009 | Gray | |
| 2010/0155142 | A1 | 6/2010 | Thambynayagam et al. | |
| 2010/0224360 | A1* | 9/2010 | MacDougall | E21B 17/07 166/250.01 |
| 2010/0250139 | A1* | 9/2010 | Hobbs | E21B 47/12 702/6 |

OTHER PUBLICATIONS

International Search Report for PCT Application Serial No. PCT/US2012/023345 dated Sep. 24, 2012.

"Successful Integration of Geomechanics and Mud Engineering at the Wellsite," by Mario Zamora, Quanxin Guo and Sanjit Roy, presented at the 10th Offshore Mediterranean Conference and Exhibition in Ravenna, Italy, Mar. 23-25, 2011.

"A Practical Design Tool for Wellbore Strengthening," by Quanxin Guo, Sanjit Roy, Douglas Simpkins, Mario Zamora, Paper AADE-2009-NTCE-12-05, presented at the AADE National Technical Conference, New Orleans, Mar. 30-Apr. 2, 2009.

* cited by examiner

METHOD OF MINIMIZING WELLBORE INSTABILITY

BACKGROUND OF INVENTION

Geomechanical and drilling fluid engineers share the common goal of maintaining proper mud weights to minimize wellbore instability during drilling. However, their efforts are often out of sync with regard to time frame, data resources, uncertainties, responsibilities, and sense of urgency. Attempts to resolve these issues in the past have encountered mixed results, primarily because the two groups utilize different technology and communicate differently.

Wellbore stability planning on complex wells is the domain of geomechanical engineers who base their recommendations on offset log analyses, well histories, geomechanical models, and knowledge of the area. Using these recommendations as guidelines, rig personnel respond to changing and unexpected well conditions by continually monitoring and adjusting mud properties and drilling practices. However, drilling fluid engineers charged with recommending and maintaining proper mud weights rarely have access, training, or time to execute geomechanical software as part of their duties. Likewise, geomechanical engineers rarely get continual updates (unless problems are encountered) and their software usually is not designed to handle certain types of data, including fuzzy data provided by wellsite drilling personnel.

Wellbore instability is one underlying cause of non-productive time during well construction. While a diversity of parameters affect the instance and degree of instability, factors including downhole mud density and equivalent circulating density profiles can contribute to wellbore instability when these densities are not appropriate for a particular formation or well profile, especially in highly deviated wells. Optimum mud weights are selected based on offset well analyses, detailed well plans, analyses and interpretation of ongoing well conditions, considerations for different density-dependent operations, and recommendations from other wellsite personnel including drilling fluids engineers, also called mud engineers. This multi-pronged approach, may result in uncertainty, lose effectiveness when information and resources are not readily available or the information is not communicated with everyone involved in making decisions and implementing solutions. Efforts can be out of sync with regard to time frame in which solutions should be implemented, data resources used to make decisions, uncertainties, responsibilities, and sense of urgency in a given situation.

SUMMARY

In one aspect, the claimed subject matter is generally directed to a method for reducing wellbore instability. A process for reducing wellbore instability includes inputting pre-drilling assessment information into an hydraulics analysis and wellbore stability application, inputting a well plan into the hydraulics and wellbore analysis application, inputting a parameter measured at the wellsite into the hydraulics and wellbore stability analysis application, inputting an observation made at the wellsite into the hydraulics and wellbore stability analysis application, integrating the pre-drilling assessment information, the measured parameter, and the observation into the wellbore strengthening analysis application, and adjusting a drilling fluid parameter in response to the integrated pre-drilling assessment information, the measured parameter, and the observation.

In another aspect of the claimed subject matter, an application for integrating geomechanics and drilling fluids engineering includes a wellbore stability engine, an input processor providing wellsite data to the wellbore stability engine, the input processor also providing a pre-drilling plan to the wellbore stability engine, the third party data being provided to the wellbore stability engine, and a report generated by the wellbore stability engine, the report including information resulting from third party data, the pre-drilling plan, and data measured at the wellsite.

In yet another aspect, the claimed subject matter relates to a method for generating wellbore stability reports including inputting an initial parameter into a wellbore stability engine, providing a well plan from the wellbore stability engine based on the initial parameter, inputting a wellsite parameter into an input processor, inputting the well plan into the input processor, providing the wellsite parameter and well plan from the input processor to the wellbore stability engine, and generating a report from the wellbore stability engine based on the wellsite parameter and well plan from the input processor.

Other aspects and advantages of the claimed subject matter will be apparent from the following description and the appended claims.

DETAILED DESCRIPTION

Figure 1:
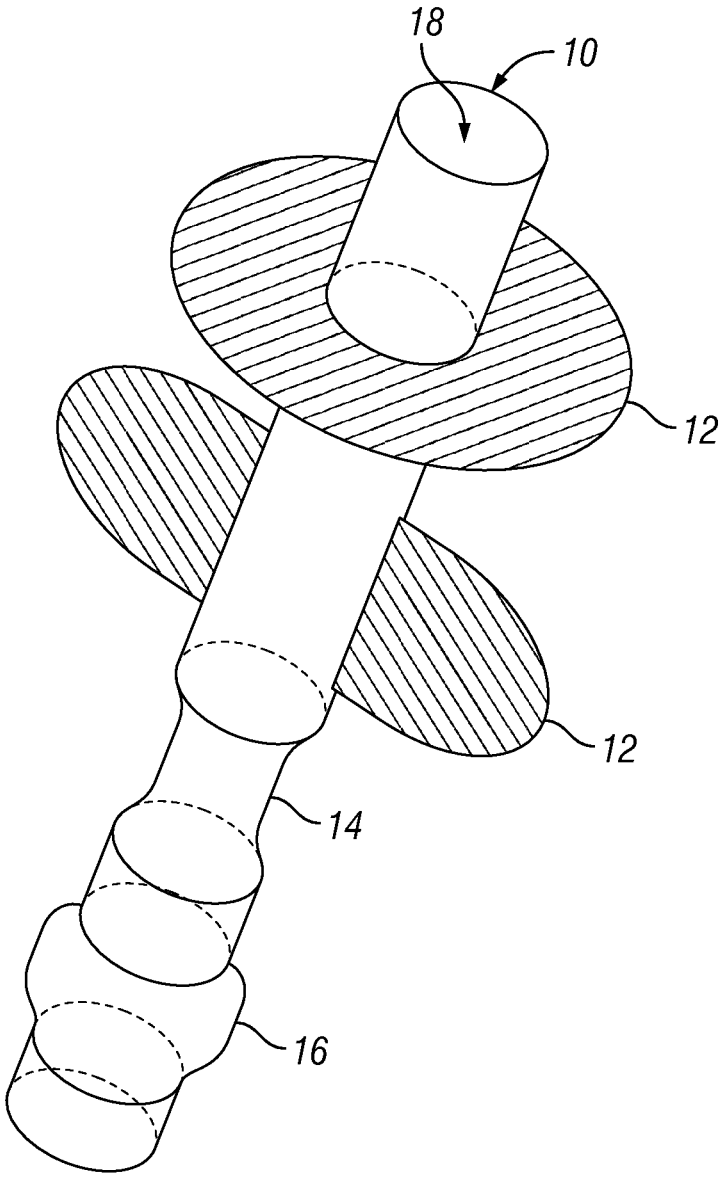
FIG. 1 is a schematic of a wellbore illustrating different types of instabilities.

To define more clearly the terms used herein, the following definitions are provided. To the extent that any definition or usage provided by any document incorporated herein by reference conflicts with the definition or usage provided herein, the definition or usage provided herein controls.

The term "equivalent circulating density" is used herein to mean the effective density exerted by a circulating fluid against the formation that takes into account the pressure loss in the annulus above the depth being considered.

The term "equivalent static density" is used herein to mean the effective density a depth of interest of a static column of fluid exposed to downhole temperatures and pressures.

The term "high temperature/high pressure" is used herein to mean a well having an undisturbed bottomhole temperature of greater than 300° F. [149° C.] and a pore pressure of at least 0.8 psi/ft (~15.3 lbm/gal).

The term "breakout" is used herein to mean the occurrence where near-wellbore rocks break into pieces and fall in the well.

The term "caving" is used herein to mean the occurrence of pieces of rock that came from the wellbore but that were not removed directly by the action of the drill bit. Cavings can be splinters, shards, chunks and various shapes of rock, usually spalling from shale sections that have become unstable. The shape of the caving can indicate why the rock failure occurred.

The term "pre-drill assessment" is used herein to mean wellbore stability evaluation and assessment before drilling.

The term "well plan" is used herein to mean the description of a proposed wellbore, including the shape, orientation, depth, completion, and evaluation.

The term "rock-failure model" is used herein to mean a model to evaluate how the rock fails either in compressive failure or in tensile failure.

The term "linear elastic model" is used herein to mean the relationship between the force and the deformation is linear and there is no residual deformation when the force is removed.

The term "modified Lade failure criterion" is used herein to mean a failure criterion which considers more general stress state than other failure criteria.

The term "lost circulation" is used herein to mean mud loss to the formation.

The term "tight hole" is used herein to mean a section of a wellbore, usually openhole, where larger diameter components of the drillstring, such as drillpipe tool joints, drill collars, stabilizers, and the bit, may experience resistance when the driller attempts to pull them through these sections.

The term "washout" is used herein to mean an enlarged region of a wellbore.

The claimed subject matter relates to a process for minimizing wellbore instability issues and an application for integrating geomechanical analyses conducted prior to drilling a wellbore, updating said analyses and recommending remedial actions using observations and data collected during drilling and tripping operations. A process that integrates efforts by geomechanical and mud engineers who share the common goal of recommending mud weights to solve wellbore instability issues is discussed herein.

Referring to FIG. 1, a schematic of a wellbore 10 is shown with different types of instabilities. When a well is drilled, the rock surrounding the hole takes the load that was previously supported by the removed rock. As a result, an increase in stress around the wall of the borehole 18, a stress concentration, is produced. Examples of events that can occur when the mud weight is too high include fractures and/or mud loss 12. Mud loss or lost circulation can occur when equivalent static densities and equivalent circulating densities exceed the formation fracture resistance. If the rock is not strong enough or if the mud weight is not high enough to support the wellbore, the borehole may fail in shear in the form of tight hole 14, sloughing (rock fragments break off from the wall and fall in the wellbore), or caving and hole collapse 16 or hole enlargement. Tight hole 14, breakouts, cavings 16, and/or destructive hole collapse can result when equivalent static densities are too low. When pressure margins between fracture and hole collapse are very low, such as those encountered in deepwater and high temperature/high pressure drilling, the potential for wellbore instability issues, such as those described, increases.

On a rig, drilling fluid engineers work to maintain drilling fluid properties such as density, rheological properties, and chemical properties. Geomechanical engineers generate boundaries for operating mud windows and recommended mud-weight strategies, based on analyses of offset log data, well histories, geomechanical models, and knowledge of the area based on formation characterization and pre-drill wellbore stability (WBS) studies. Most geomechanical engineers work in an office environment using complex computer models and/or laboratory testing techniques to address stability issues from mechanical and stress perspectives and to conduct in-depth root-cause analyses. Interactions between the drilling fluid engineers and the geomechanical engineers can occur either before spud when mud engineers need geomechanical assistance for supporting mud programs, or during well construction when geomechanical engineers are following an existing or potentially major wellbore instability problem.

Many complex wells are highly dependent on detailed geomechanics studies, and perhaps could not be drilled without proper planning. However, no plan can anticipate well conditions to the extent that instability problems are effectively and consistently mitigated. Some parameters can only be estimated during planning.

Drilling fluid engineers focus on a wide range of drilling fluid issues at the wellsite, especially mud weight for well integrity and wellbore stability. Pre-drill plans may be continually adjusted to address changing drilling conditions and well events observed real-time at the wellsite. Unfortunately, most drilling fluid engineers are unable to integrate complex geomechanical analyses into their normal duties.

Clearly, A process has been developed to integrate geomechanical and drilling fluid engineering wellbore stability processes. The process is controlled by an application to be used at the wellsite by drilling fluid engineers because of their proximity to drilling operations and their responsibilities as first responders in the event of a wellbore instability issue. The process and application seamlessly (a) convert field observations and measurements into data used by a rigorous stability model and other wellbore stability and strengthening applications, and (b) generate wellbore stability reports and interactive three dimensional (3D) visualization models of the downhole wellbore environment. The approach minimizes additional effort in the field by the drilling fluid engineer to generate useful wellbore stability analyses and information.

Integrated Workflow

Figure 2:
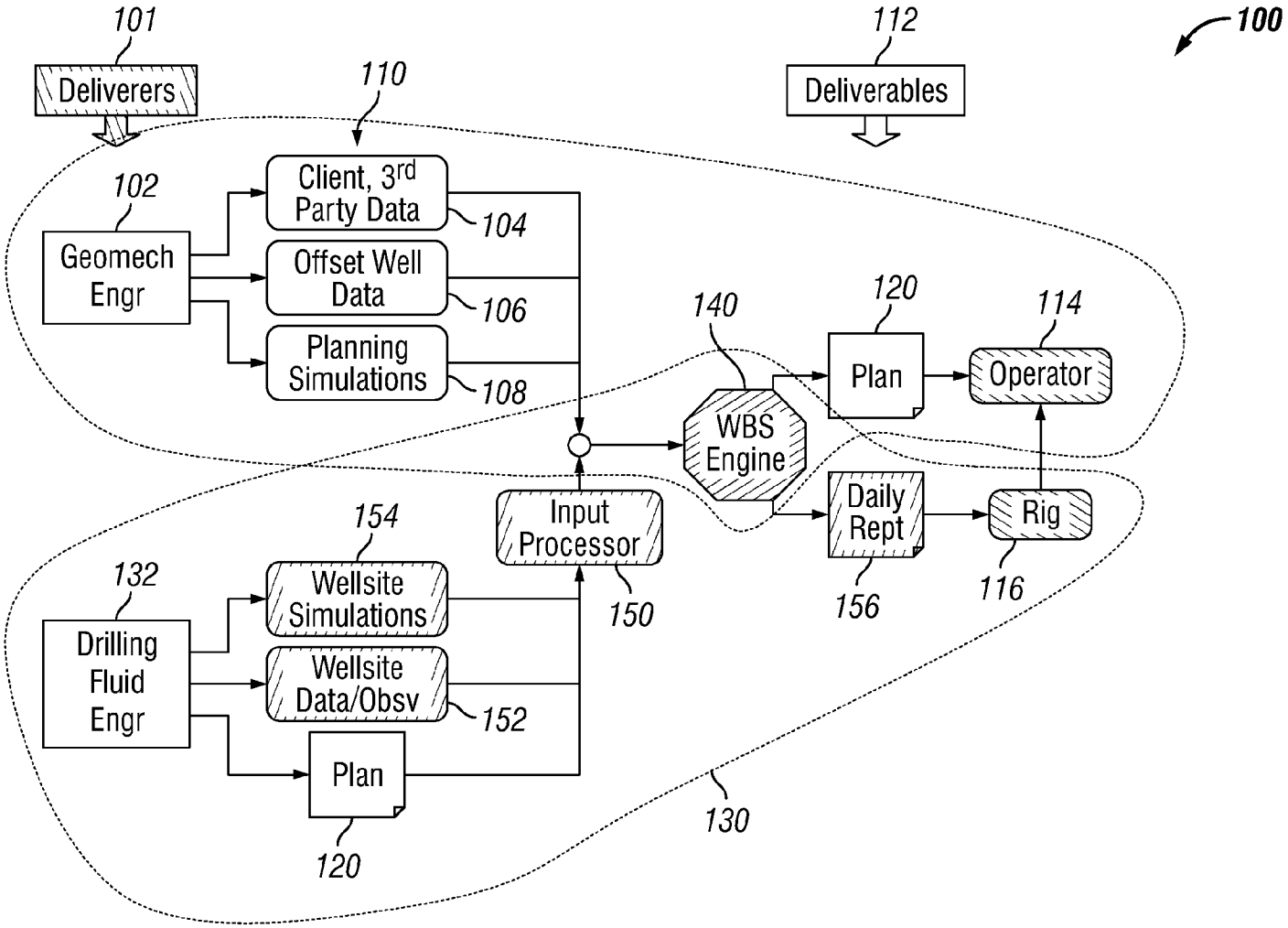
FIG. 2 is a process flow diagram in accordance with embodiments disclosed herein.

The flowchart in FIG. 2 presents an integrated process (100). The deliverers 101 include a geomechanical engineer 102 and a drilling fluid engineer 132. The upper path 110 shows the process followed by the geomechanical engineer 102. At the right side of the geomechanical process 110, the deliverable to the operator 114 is the well plan 120. To create the well plan 120, the geomechanical engineer 102 takes many factors into account. These factors may include client and third party data 104, including data from the wellsite and/or nearby wells, offset well data 106, and planning simulations 108, including geomechanical models.

The lower path 130 represents the process for drilling fluid engineers. The drilling fluid engineer process incorporates the well plan 120 and wellsite measurements and observations 152, calculations and wellsite simulations 154 to address stability issues. The deliverable for the drilling fluid engineer process 130 is a wellbore stability report 156 for delivery to wellsite and operator staff personnel 116 and 114. Such wellbore stability reports 156 may be prepared daily.

Continuing to refer to FIG. 2, the "WBS Engine" 140 is used by both the drilling fluid engineer process 130 and the goemechanical engineer process 110. The quantity of complex input parameters used by geomechanical software models has previously been barrier for its use by drilling fluids engineers who may not be well versed in geomechanics theories and principles. Mud engineers have little access, training, or time to execute sophisticated geomechanical models and software as part of their normal duties.

The "input processor" 150 accepts traditional observations 152 and measurements 154 collected by drilling fluid engineers 132 as inputs as well as those collected by the rig. Such inputs include, for example, drilling fluid density, drilling fluid composition and/or type, flow rates, penetration rate, rotary speed, weight on bit, and fluid temperature. The input processor 150 automatically uses observations 152, measurements 154, and data from the well plan 120 through fuzzy logic methods to generate the input values used to drive the WBS engine 140 regardless of its complexity. Results are generated and may be provided in the form of a wellbore stability report 156. The reports can be provided to rig supervisory personnel 116, the operator 114, and/or the geomechanical engineers 102 responsible for the drilling and geomechanical well plans 120.

The integrated geomechanical process 100 allows the geomechanical engineer 102 to develop a well plan 120 utilizing operating windows based on the best available pre-drill assessment of earth stresses. The same application then allows drilling fluid engineers 132 to use the well plan 120 as a starting point, and combine it with current data, observations and measurements 152 and simulations 154 to uniquely adjust the operating window or other actions at the wellsite as drilling progresses.

For the process 100 to succeed, the well plan 120 generated by the geomechanical engineer 102 is integrated into the WBS engine 140. This permits access from the wellsite module, which directs the drilling fluid engineer process 130 and minimizes duplication of data entry and complex processing such as equivalent static densities and equivalent circulating densities. The geomechanical engineer 102, generates the well plan 120 but may not have access to operator and quality offset well information 104, 106 which could be included. Assistance from resident experts and information from third-party data 104 and geomechanical studies 108 may be included as factors in developing the well plan 120 for complex wells, such as wells that are difficult to drill or costly to drill, including deep, deepwater, high temperature/high pressure, wells requiring extended reach drilling and ultra extended reach drilling, and wells drilled in remote locations.

WBS Engine

The platform for the integrated geomechanics process is the WBS engine 140. The WBS engine 140 may be, for example a wellbore hydraulics analyses software package for simulations involving downhole equivalent static densities, equivalent circulating densities, pump pressures, temperature profiles, hole-cleaning, surge-swab, and other drilling engineering operations and issues.

Techniques and strategies used in the WBS engine 140 may also be used to conduct detailed geomechanical analyses. The WBS engine 140 may use a finite-difference scheme to sub-divide wells into short segments, each with its own set of properties. The subdivision of wells into short segments allows integration of parameters specific to wellbore stability analyses, including earth stresses, rock properties, and pore pressures. The effects of temperature and pressure on downhole drilling fluid density and rheology and simulated equivalent circulating density profiles maybe combined with rock-failure models to determine the state of wellbore integrity based on current operating conditions. A consideration in making this determination is the ability to translate contextual and fuzzy inputs into parameters which are used for the geomechanical model using the input processor 150 described previously.

One application of the wellbore hydraulics analyses software is to simulate the equivalent density profile based on current operating conditions and time-dependent downhole fluid properties. Positioning the equivalent static density and equivalent circulating density profiles within defined operating windows based on pore pressures and fracture gradients during any well-construction operation can be used to ensure wellbore integrity or stability. This task is performed as part of both office-based project, or geomechanical process 110 and wellsite engineering process, or drilling fluid engineer process 130, during planning and operational stages, respectively.

Figure 3A:
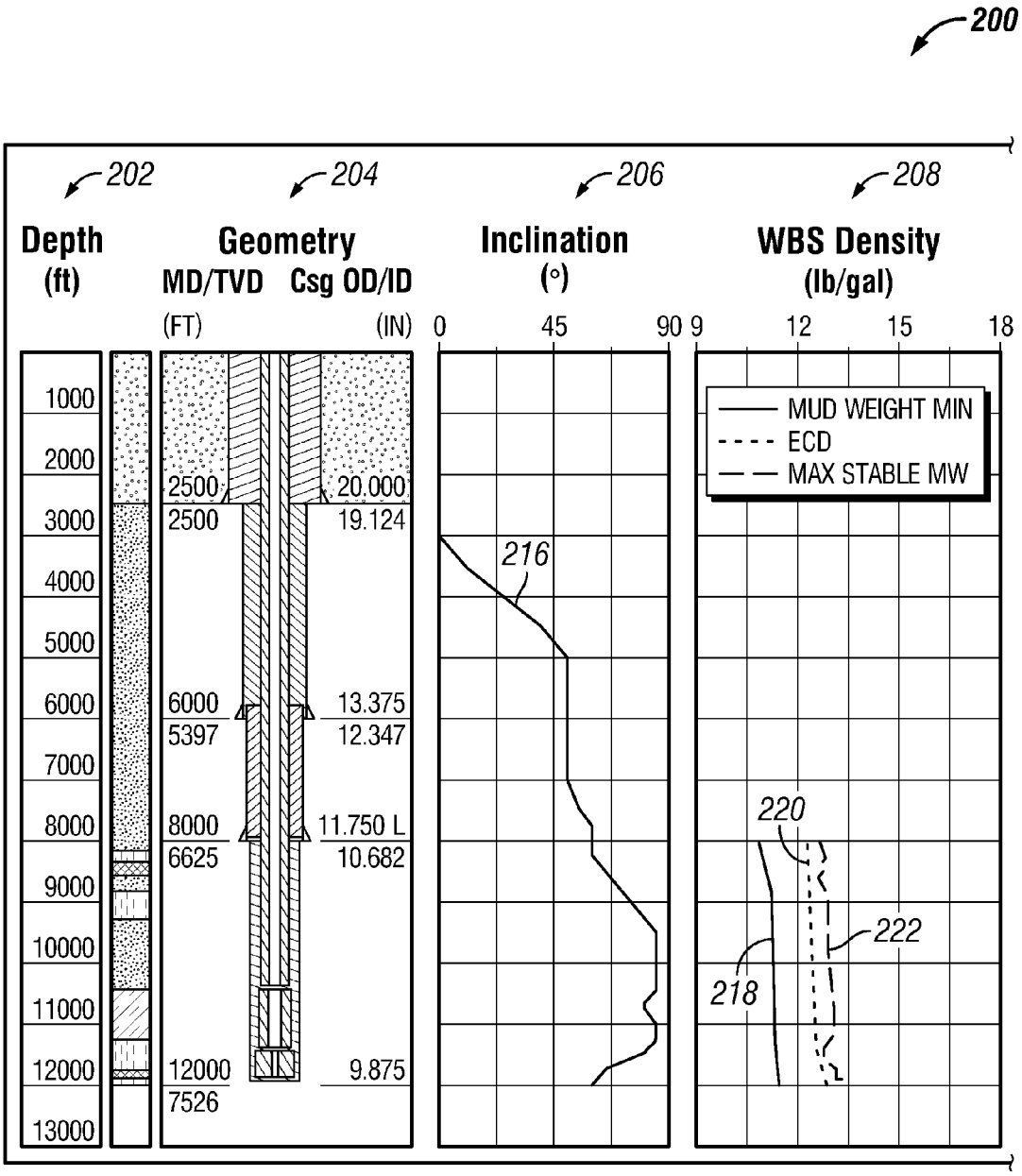
FIG. 3 is a graphical report generated in accordance with embodiments disclosed herein.
Figure 3B:
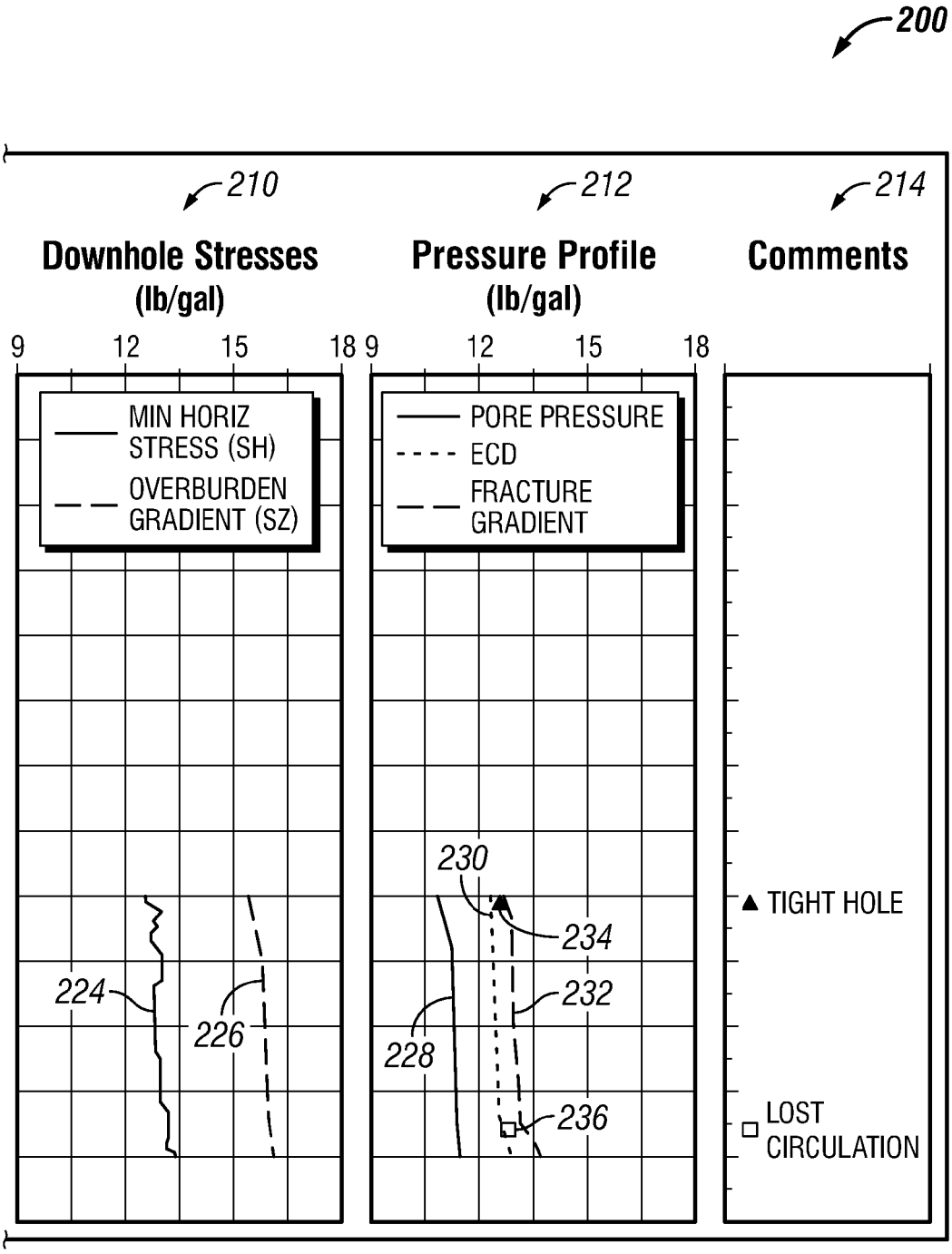

Deviations from the well plan 120 or unexpected occurrences can be quickly and easily incorporated into the wellbore stability and strengthening analyses to help achieve wellbore integrity. Referring to FIG. 3, an example of how unplanned events are superimposed over graphical snapshots to visually demonstrate integration of geomechanical results and hydraulics analyses to present a comprehensive view of wellbore stability is shown. FIG. 3 shows a graphical report 200 such as that which may be generated by the WBS engine 140. The report 200 shows the depth of drilling 202, the well geometry 204, inclination 206, WBS density, 208, downhole stresses 210, pressure profile 212, and comments 214. The inclination 206 is graphed along the depth of the well as a percentage and shown at line 216. The WBS Density 208 shows the mud weight 218, the equivalent circulating density 220, and the maximum stable mud weight 222 along the depth of the well. The graph of downhole stresses 210 shows the minimum horizontal stress 224 and the overburden gradient 226 along the depth of the well. The pressure profile graph 212 shows the pore pressure 228, the equivalent circulating density 230 and the fracture gradient 232 along the depth of the well. A first unplanned event 234 is shown on the pressure profile 212. The first unplanned event was a tight hole. A second unplanned event 236 is also shown on the pressure profile 212. The second unplanned event was lost circulation. The unplanned events can be found in the comments column 214. Conventional companion summary reports may also be generated and submitted to rig supervisors.

Figure 4:
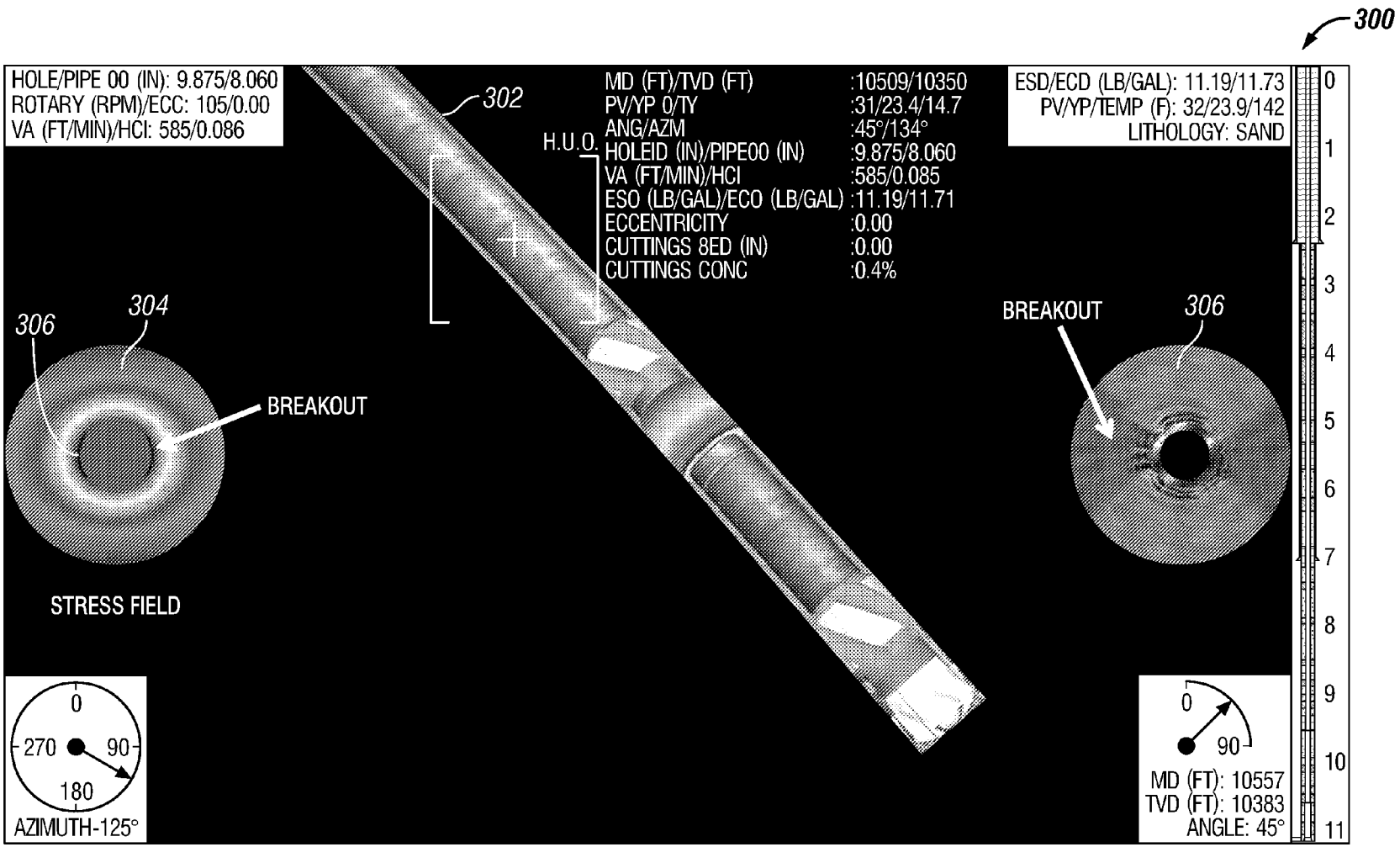
FIG. 4 is a screenshot of a three dimensional visualization of a geomechanical analysis in accordance with embodiments disclosed herein.

Referring to FIG. 4, calculated downhole stress fields may also be added to an interactive 3D visualization 300 which may be used to examine the inside of virtual wellbores 302 while navigating the well from surface to the total depth, that is to the planned end of the well as measured by the length of pipe required to reach the bottom. A standard PC and a gamepad, joystick, and/or keyboard may be used to navigate a virtual wellbore 302. Three dimensional perspectives may show radial stress distributions 304 and the position and extent of wellbore instability issues around the wellbore at depths of interest. An example of a wellbore instability issue is shown in FIG. 4 as a breakout 306. The stress distributions 304 and any wellbore instability issues are superimposed over internal and side projections of well tortuosity, cuttings beds, the drill string (including eccentricity), annular velocity profiles, downhole engineering parameters (temperatures, equivalent static densities, etc.), and downhole tools. The 3D visualization permits drilling fluid engineers and other personnel who may not be familiar with geomechanical intricacies to easily appreciate and visualize the scope and nature of wellbore instabilities and to quickly evaluate the impact and effectiveness of any adjustments.

The mud weight window serves as one design factor for the design of both the well and drilling fluid system. It defines the range between the minimum weight to avoid well collapse (compressive or shear failure) and the maximum mud weight to avoid formation breakdown (tensile failure). Compressive or shear failure depends on the borehole stress and rock strength or failure criterion, while tensile failure or fracturing depends on the borehole stress and formation fracture gradient.

As previously discussed, when a well is drilled, the rock surrounding the hole takes the load that was previously supported by the removed rock resulting in an increase in stress around the wall of the borehole. If the rock is not strong enough or if the mud weight is not high enough to support the wellbore, the borehole may fail in shear in the form of tight hole, sloughing (rock fragments break off from the wall and fall in the wellbore), or caving and hole enlargement.

When the borehole pressure is too high, that is, when the borehole pressure is higher than the fracture pressure, then fracturing or splitting of the borehole occurs, resulting in mud loss and possible well-control issues. Fracture gradients may be projected based on fracturing measurements made on offset wells or at depths less that the depths of interest. Such fracturing measurements may come from leakoff tests and formation integrity tests. Formation fracture gradients may also depend on well deviation and trajectories that are different than those where the measurements were taken. Wellbore stability models extrapolate data to predict look-ahead scenarios based on these differences, and any available well testing or drilling event data. Various wellbore stability models may be used. The WBS engine 140 may use a linear elastic model that addresses deviated wellbores under anisotropic stresses. the linear elastic model addresses many of the drilling events observed at the wellsite, such as fracturing, loses of mud, tight holes, and cavings.

The WBS engine 140 may also use the modified Lade failure criterion. The modified Lade criterion is a three-dimensional failure criterion that uses two empirical constants which may be determined from triaxial tests.

Implementation

A component of the process is the capturing and archiving of wellbore stability-related events and observations made by the drilling fluid engineer, and the subsequent use of the events and observations to calibrate wellbore stability model parameters for the analyses. This near-real-time update to the geomechanics model elevates the process beyond traditional approaches where geomechanics experts often do not participate in wellsite activities or interact with wellsite personnel during the drilling phase. The archived events and observations can be presented daily or on demand to wellsite personnel, and can also be used for end-of-well analyses and planning of subsequent wells drilled in the region.

Examples of wellbore stability-related events captured in the WBS engine 140 include lost circulation, tight hole, washout, hole collapse, and wellbore influx. Data associated with the event can then be used to adjust geomechanical model parameters using fuzzy and contextual data. For example, a severe lost circulation zone may indicate deficiencies in accurate modeling of stress regimes, or it may indicate weaker-than-expected rock properties. This information further combined with bit parameters such as mechanical specific energy can be used to distinguish stress-regime and rock-property effects. Integration of the geomechanical analyses into the WBS engine 140 also allows interactive investigation of the impact of one parameter on another parameter. For example, flow rate increases that assist with hole cleaning may also increase equivalent circulating density profiles and cause stability concerns. Another example of the application of fuzzy and contextual data in the WBS engine 140 is how changes in mud density to maintain adequate equivalent static densities impact the equivalent circulating densities and flow rates that maintain wellbore stability and satisfy hole-cleaning requirements. These simulations can be performed at the wellsite by the drilling fluid engineer to ensure that optimum drilling conditions are maintained.

This process uses available mud engineering and mud logging data to characterize wellbore response to different drilling operations and transformation of "fuzzy" observations into engineering values to drive the analytical model. This process further provides the use of real-time drilling data to provide real-time wellbore stability-related information.

The current linear elastic model may be updated to consider poro-elasticity and thermal and chemical effects on stresses near the wellbore. While complex models use a variety of additional rock properties and empirical constants for input, much of the supporting information already is simulated. Other data can be incorporated through the input processor 150.

Additional models and inputs may be developed and calibrated into additional geomechanics modules or utilities. For example a fracture-width prediction module may be added to provide information relevant to the selection of lost-circulation-material blends and concentrations for wellbore strengthening applications.

Geomechanical and wellsite drilling fluid engineers share the common goal of recommending mud weights to effectively mitigate, diagnose, and remediate wellbore stability issues.

The process provides information to first-responder drilling fluid engineers, with full consideration of their lack of time, resources, and training to apply complex methods for analyzing geomechanical conditions at the wellsite.

Integration of wellbore-stability software tools into an hydraulics program provides the ability to execute rigorous stability analyses enhanced by observations and measurements made at the wellsite.

Additional benefits include incorporating wellbore stability analyses into an interactive system that models and visualizes changing downhole conditions.

Field observations and real-time drilling measurements can be converted into parameters used by wellbore stability models in the WBS engine 140.

While the claimed subject matter has been described with respect to a limited number of embodiments, those skilled in the art, having benefit of this disclosure, will appreciate that other embodiments can be devised which do not depart from the scope of the claimed subject matter as disclosed herein. Accordingly, the scope of the claimed subject matter should be limited only by the attached claims.

What is claimed is:

1. A method for reducing wellbore instability comprising:

inputting pre-drilling assessment information into a hydraulics and wellbore stability analysis application to create a well plan;

inputting a parameter measured at the wellsite as a wellbore is drilled into the hydraulics and wellbore stability analysis application;

inputting an observation made at the wellsite as the wellbore is drilled into the hydraulics and wellbore stability analysis application;

integrating the well plan, the measured parameter, and the observation into the hydraulics and wellbore stability analysis application continually;

visually displaying a wellbore stability report comprising results of the integrated well plan, the measured parameter, and the observation; and adjusting operating window, drilling fluid, or drilling conditions at the wellsite as drilling progresses based on the wellbore stability report.

2. The method of claim 1, wherein the pre-drilling assessment information includes at least one input selected from data consisting of: client data, third party data, offset well data, drill bit data and planning simulations.

3. The method of claim 1, wherein the parameter measured at the wellsite includes at least one selected from the group consisting of: downhole equivalent static density, equivalent circulating density, pump pressures, flow rates, rheological properties, temperature profiles, and tripping rate.

4. The method of claim 1, wherein the observation made at the wellsite includes at least one selected from the group consisting of: return cuttings volume, return cuttings shape, and a return drilling fluid characteristic.

5. The method of claim 1, further comprising:

determining a state of wellbore integrity based current operating conditions.

6. The method of claim 1, further comprising:

inputting wellbore stability related events into the hydraulics and wellbore stability analysis application; and calibrating the hydraulics and wellbore stability analysis application based on the wellbore stability related events.

7. A non-transitory program storage device readable by a machine tangibly embodying a program of instructions executable by the machine to perform method steps adapted for integrating geomechanics and drilling fluids engineering, said method steps comprising:

a wellbore stability engine;

an input processor supplying wellsite data measured at the wellsite during drilling to a wellbore stability engine by an input processor;

wherein the input processor also supplying a pre-drilling plan to the wellbore stability engine;

wherein supplying third party data are provided to the wellbore stability engine; and generating a visual report generated by the wellbore stability engine;

wherein the visual report includes wellbore stability information resulting from third party data, the pre-drilling plan, and the data measured at the wellsite;

wherein operating window, drilling fluid, or drilling conditions at the wellsite are adjusted based on the visual report as drilling progresses.

8. The non-transitory program storage device of claim 7, wherein data measured at the wellsite includes at least one parameter selected from the group consisting of: downhole equivalent static density, equivalent circulating density, pump pressure, flow rate, drilling fluid rheology, temperature, and tripping rate.

9. A method for generating wellbore stability reports comprising:

inputting an initial parameter into a wellbore stability engine;

supplying a well plan from the wellbore stability engine based on the initial parameter;

inputting a wellsite parameter comprising drilling fluid data measured at the wellsite during drilling continually into an input processor;

inputting the well plan into the input processor;

supplying the wellsite parameter and well plan from the input processor to the wellbore stability engine;

generating a visualized wellbore stability report from the wellbore stability engine based on the wellsite parameter and well plan from the input processor; and adjusting operating window, drilling fluid, or drilling conditions at the wellsite as drilling progresses based on the visualized wellbore stability report.

10. The method of claim 9, wherein said report is generated daily.

11. The method of claim 9, wherein said report is generated on demand.

12. The method of claim 9, wherein the initial parameter includes at least one input selected from data consisting of: client data, third party data, offset well data, drill bit data and planning simulations.

13. The method of claim 9, wherein the wellsite parameter includes at least one selected from the group consisting of: downhole equivalent static density, equivalent circulating density, pump pressures, flow rates, rheological properties, temperature profiles, and tripping rate.

14. The method of claim 9, further comprising: positioning an equivalent static density and equivalent circulating density profile within the adjusted operating window.

15. A method for reducing wellbore instability, comprising:

inputting geomechanical well plan data into a wellbore stability engine, the geomechanical well plan data comprising data from a wellsite, data from an offset well, and/or planning simulations to create a wellplan;

inputting drilling fluid data and observations taken from a well being drilled into the wellbore stability engine;

generating a wellbore stability report from the wellbore stability engine based on the wellplan and drilling fluid data and observations; and adjusting the operating window, drilling fluid, or drilling conditions at the wellsite as drilling progresses based on the wellbore stability report.

16. The method of claim 5, wherein the wellbore stability report comprises a visualization comprising wellbore data, fluid data, and formation data.

17. The method of claim 16, wherein the visualization further comprises wellbore instability events.

18. The method of claim 16, wherein the wellbore data comprises at least one data selected from the group consisting of depth, well geometry, inclination, wherein the fluid data comprises at least one data selected from the group consisting of mud weight, equivalent circulating density, and maximum stable mud weight, and wherein the formation data comprises at least one selected from the group consisting of downhole stresses and pressure profile.

* * * * *